US006536383B2

(12) United States Patent
Santiyanont

(10) Patent No.: US 6,536,383 B2
(45) Date of Patent: Mar. 25, 2003

(54) INTERNAL COMBUSTION ROTARY ENGINE

(76) Inventor: Chanchai Santiyanont, 202/1 Moo 13 Krungthepkreetha Road Sapansung, Bangkok 10250 (TH)

( * ) Notice: Subject to any disclaimer, the term of this patent is extended or adjusted under 35 U.S.C. 154(b) by 0 days.

(21) Appl. No.: 09/396,079

(22) Filed: Sep. 14, 1999

(65) Prior Publication Data

US 2002/0056420 A1 May 16, 2002

(30) Foreign Application Priority Data

Sep. 18, 1998 (TH) ..... 046184

(51) Int. Cl.[7] ..... F02B 57/00
(52) U.S. Cl. ..... 123/44 D
(58) Field of Search ..... 123/44 D, 43 R, 123/43 B

(56) References Cited

U.S. PATENT DOCUMENTS 1,249,845 A * 12/1917 Soppitt ..... 123/44 D
2,990,820 A * 7/1961 Saijo ..... 123/44 D
4,077,365 A * 3/1978 Schlueter ..... 123/44 D
4,106,443 A * 8/1978 Triulzi ..... 123/43 R
4,166,438 A * 9/1979 Gottschalk ..... 123/44 D
4,370,109 A * 1/1983 Sabet et al. ..... 123/43 B
4,421,073 A * 12/1983 Arregui et al. ..... 123/43 R
5,123,394 A * 6/1992 Ogren ..... 123/44 D
5,967,102 A * 10/1999 Huang ..... 123/44 D
6,062,175 A * 5/2000 Huang ..... 123/44 D

FOREIGN PATENT DOCUMENTS

CH 601657 * 12/1977 ..... 123/44 D
DE 329203 * 11/1920 ..... 123/44 D
JP 64-29601 * 1/1989

* cited by examiner

*Primary Examiner*—Michael Koczo
(74) *Attorney, Agent, or Firm*—Ladas & Parry

(57) ABSTRACT

An internal combustion rotary engine of the type comprising a rotor, an output shaft as the rotor axis, crankshafts mounting on output shaft, pistons reciprocable in piston chambers within the rotor, piston rods connecting the pistons to the crank of crankshaft. This rotary engine is characterized by the ignition force perpendicular to the output shaft radius, by radially spaced the crankshaft axis from output shaft axis, by connection between the output shaft and the crankshafts to concurrently synchronize them.

9 Claims, 18 Drawing Sheets

FIRST SET

SECOND SET

FIRST SET

SECOND SET

INTERNAL COMBUSTION ROTARY ENGINE

FIELD OF THE INVENTION

The present invention relates generally to automotive engineering and, more specifically, to an internal combustion rotary engine of the type including reciprocating pistons which rotate around an axis of rotation.

In conventional four-stroke internal combustion engines, ignition occurs when a piston is at top position (top dead center), so explosion force passes through the center of the crankshaft (output shaft), thus some power was lost as heat energy instead of being the output driving force. The main objective of this invention is to recover the loss of power and improve the efficiency of the engine.

In 1964–1965 a new four-stroke internal combustion engine was invented, in which each piston chamber is perpendicular to the radius of the output shaft. The piston is reciprocated by rotation of its crankshaft. The piston chamber is provided with cylindrical shape valves that have curved ends to match the inner cylindrical surface of the casing in order to close and open gas inlet ports and exhaust outlet ports. The gas inlet ports, exhaust outlet ports and spark plug holding ports are formed on an outer cylinder.

Prior art, related patents are U.S. Pat. Nos. 4,421,073; 4,106,443; 4,370,109. The descriptions therein describe the internal combustion rotary engine with a somewhat similar shape as the engine of the present invention but operate according to totally different principles and details as follows.

Regarding U.S. Pat. No. 4,421,073, there is no crankshaft or it is not separated from the drive shaft. The rotor axis is eccentric to the drive shaft.

Regarding U.S. Pat. No. 4,106,443, two pistons are connected by a common rod, and operated by sliding of the common rod, not by rotating the crankshaft.

Regarding U.S. Pat. No. 4,370,109. The engine has a rotary piston, not a reciprocating piston, and operated by a piston rod, crankshaft, and drive train to rotate two sets of synchronous pistons.

SUMMARY OF THE INVENTION

An internal combustion rotary engine comprising: a casing defining a cylindrical chamber; a rotor with output shaft as an axis in the said cylindrical chamber; crankshaft with pinion gear at the rear end in the rotor; piston chamber and piston in the rotor exists; drive train provided to synchronize the rotation of the output shaft and the crankshaft.

BRIEF DESCRIPTION OF THE DRAWINGS

The above and other objectives and advantages of the present invention will be understood with reference to the following detail description of an embodiment thereof which is illustrated, by way of example, in the accompanying drawings, in which.

DETAILED DESCRIPTION OF THE DRAWINGS

Figure 1:
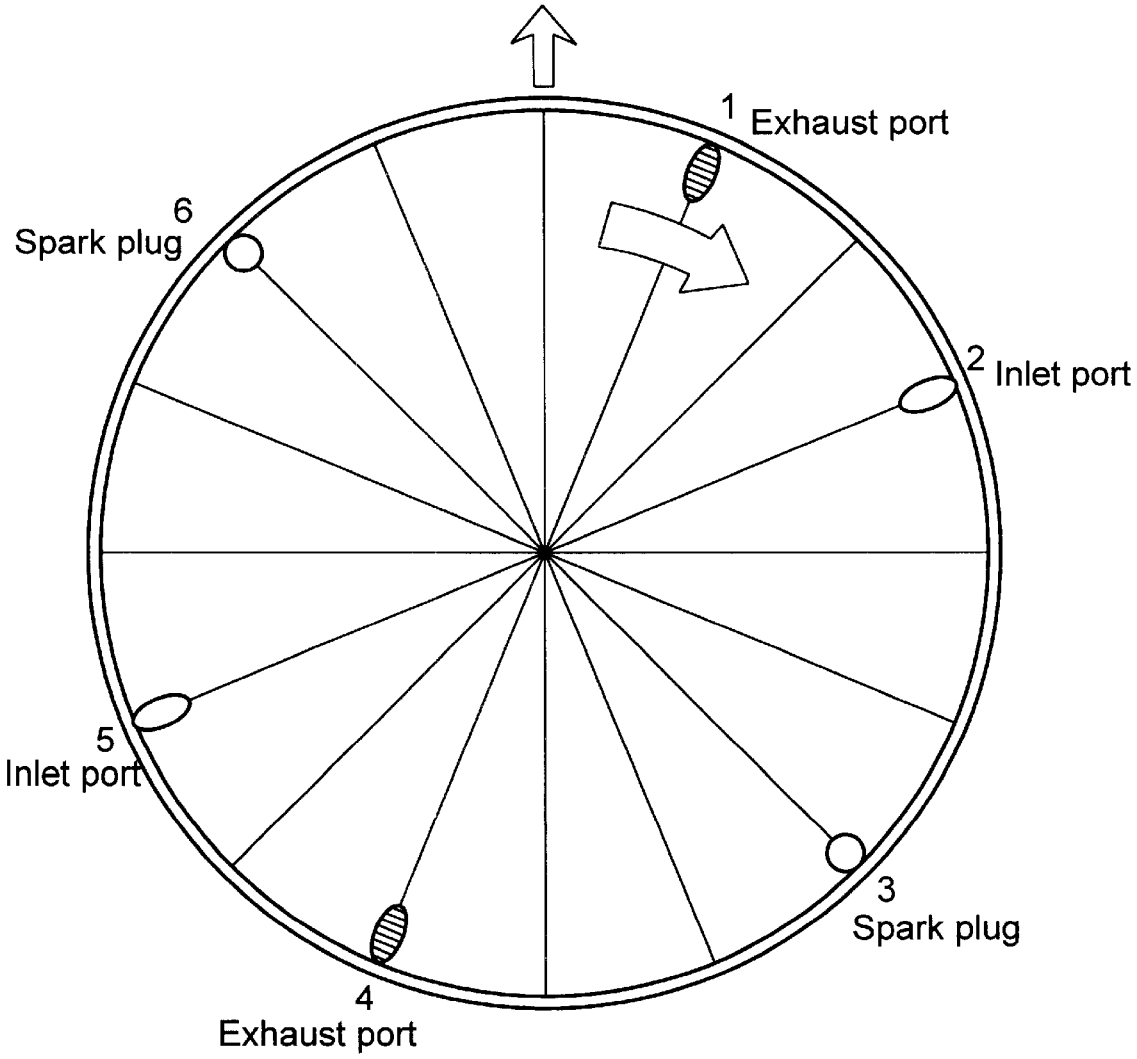
FIG. 1 is a diagram illustrating suction-port, exhaust-port and spark plug position for a first piston.

The illustrated internal combustion rotary engine comprises a casing formed with a pair of end plates 22, 24 and outer cylinder 26 securely assembled as shown to enclose a cylindrical rotor. The cylindrical rotor has output-shaft 13 as an axis. Exhaust-port 7 and suction-port 8 extend through the outer cylinder 26 to provide communication with cylindrical rotor chamber. Spark plug 9 extends through the outer cylinder 26.

The rotor includes two annular bodies 19 having a cylindrical outer surface matching the cylindrical inner surface formed by outer cylinder 26. The rotor includes a front crankshaft mounting plate 20, and a rear crankshaft mounting plate 21 secured to the annular bodies 19. The output shaft 13 is rotatably mounted and it extends through the casing via sleeve bearings in the end plates 22, 24 of the casing.

The axis of output shaft and the axis of rotor are the same (concentric) and rotate together.

Between the two annular bodies 19 of the rotor is a middle crankshaft mounting plate 53 and its cover 54. A crankshaft-mounting arm 66 is fixedly secured on the output shaft 13 for bodily rotation with it. The crankshaft-mounting arm 66 includes bearing housing 63, 65 and bearing 64. Piston chambers are fixedly secured by piston chamber bases 37 inside annular body 19 of the rotor. Each piston chamber axially extends to the outer surface of annular body 19, and wrapped by its cylindrical shape valve 18. Seal 52 is inserted in annular body 19 to prevent lube oil leakage from cylindrical shape valve 18. The axis of each piston chamber is perpendicular to the radius of output shaft 13 and preferably uniformly spaced from output shaft axis in the direction of rotor rotation. The cylindrical shape valve 18 is slightly movable along the axis in the direction of rotor rotation. The cylindrical shape valve 18 is slightly movable along the axis of its piston chamber. A curved end of the valve is pressed against the inner cylindrical surface of outer cylinder of casing 26 by coil springs 41 to keep the valve gas tight. The coil springs are seated on spring stems 42 mounted on piston chamber bases 37 and engage the lower end of cylindrical shape valve 18 to prevent the cylindrical valve from moving. At the outer surface of piston chamber base 37 is a ring 38 to prevent gas leak from cylindrical shape valve 18. Key 39 with spring is mounted in keyway 40, 44 outside of each piston chamber and inside of its cylindrical shape valve 18 respectively. An opening valve 45 is formed at the curve end of cylindrical shape valve 18 to locate the start opening position of the exhaust-port and the suction-port, and closing valve 46 is located at the start closing position of the exhaust-port and the suction-port. A piston 17, normally of cylindrical shape similar to conventional construction, is reciprocating in each piston chamber. A piston rod is pivotally connected to each piston 17 and rotatively connected to its corresponding crank of crankshaft 16 by bearing 64. The engine has two engine blocks, the first and the second block, and each block has two pistons. In the first engine block, piston chamber bases 37 are fixedly secured on crankshaft front mounting plate 20 and the cover of output shaft arm mounting plate 54. In the second engine block, piston chamber bases 37 are fixedly secured on crankshaft rear mounting plate 21 and output shaft arm mounting plate 53.

Figure 2:
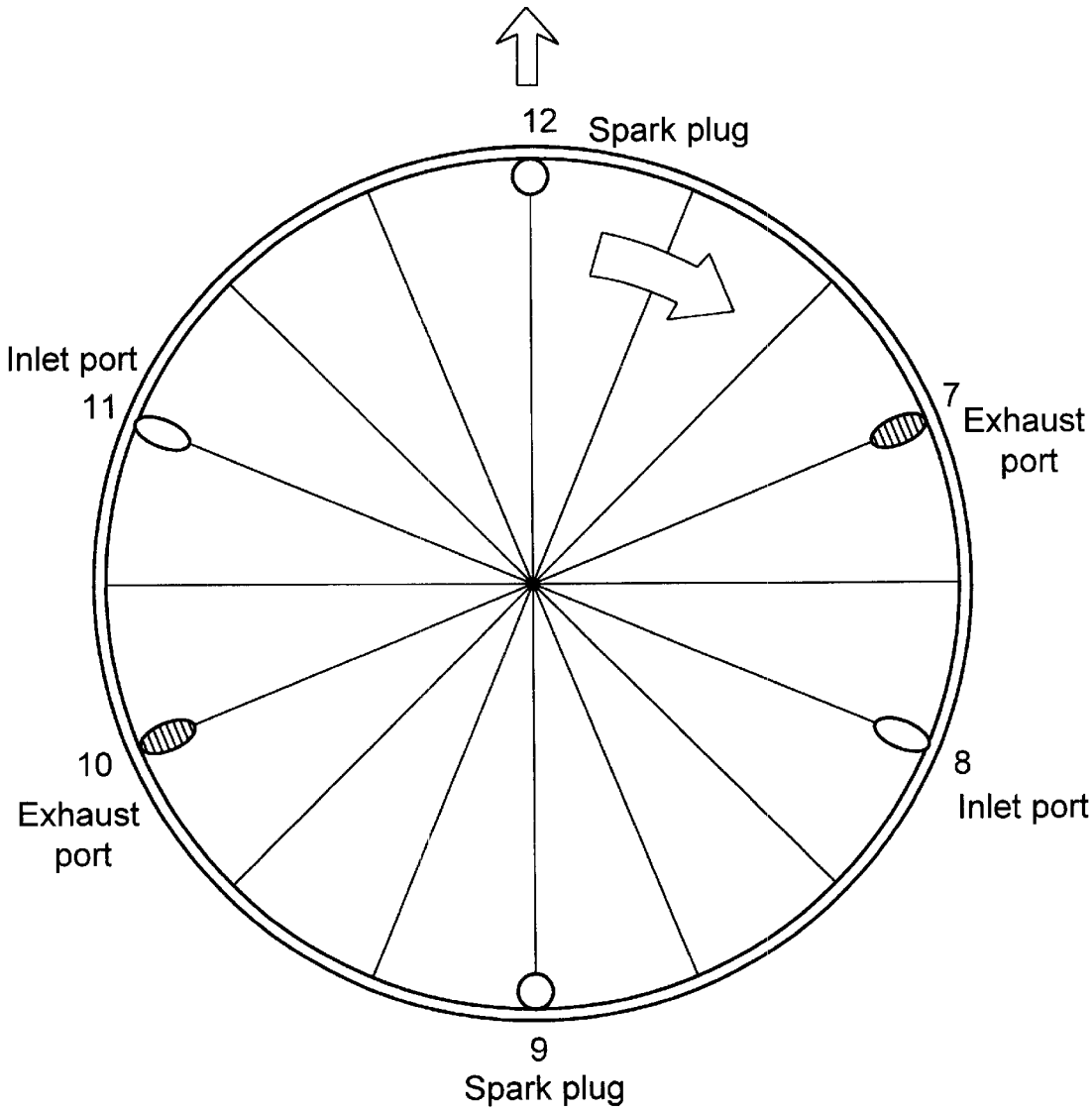
FIG. 2 is a diagram illustrating suction-port, exhaust-port and spark plug position for a second piston.
Figure 3A:
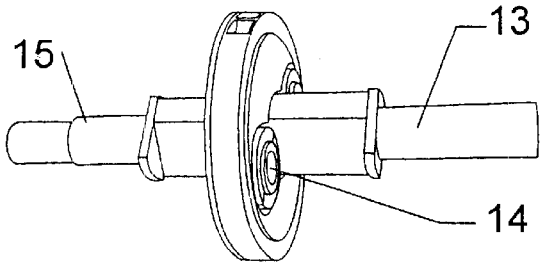
FIGS. 3A–3F are perspective views of engine components.
Figure 3B:
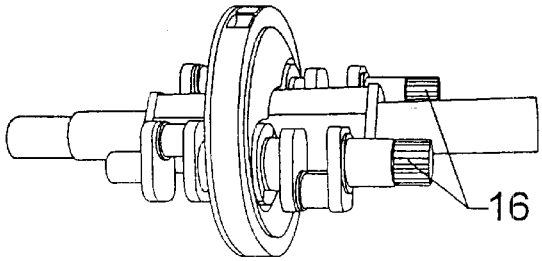
Figure 3C:
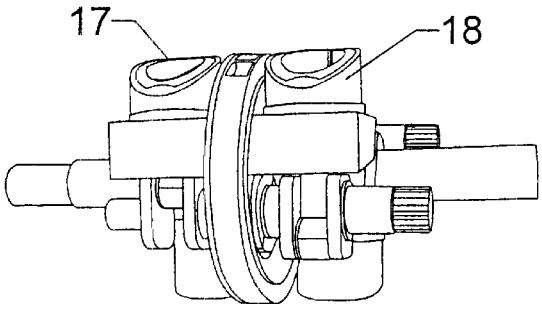
Figure 3D:
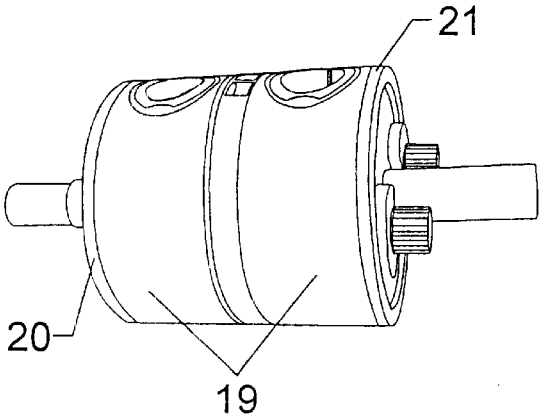
Figure 3E:
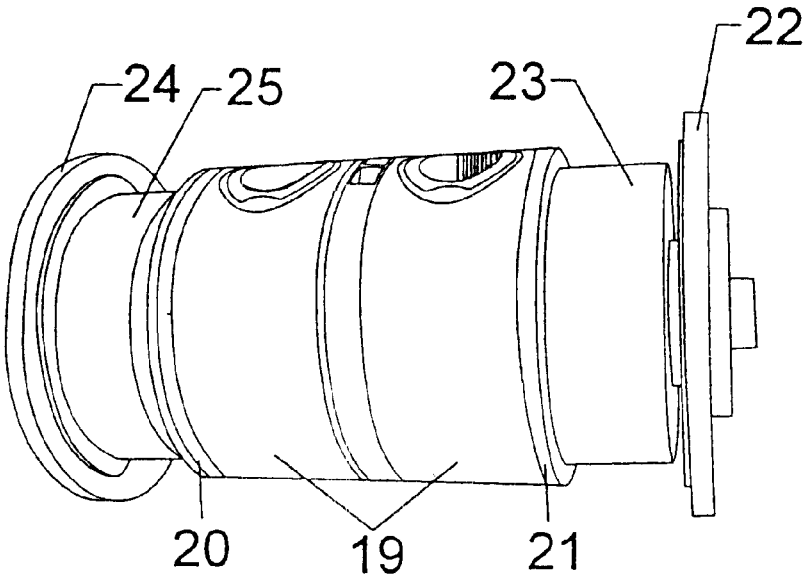
Figure 3F:
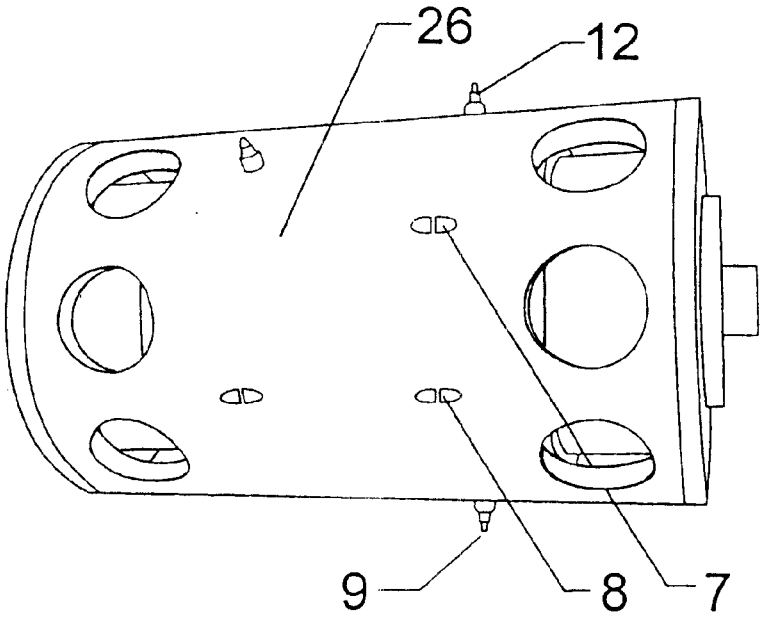
Figure 4C:
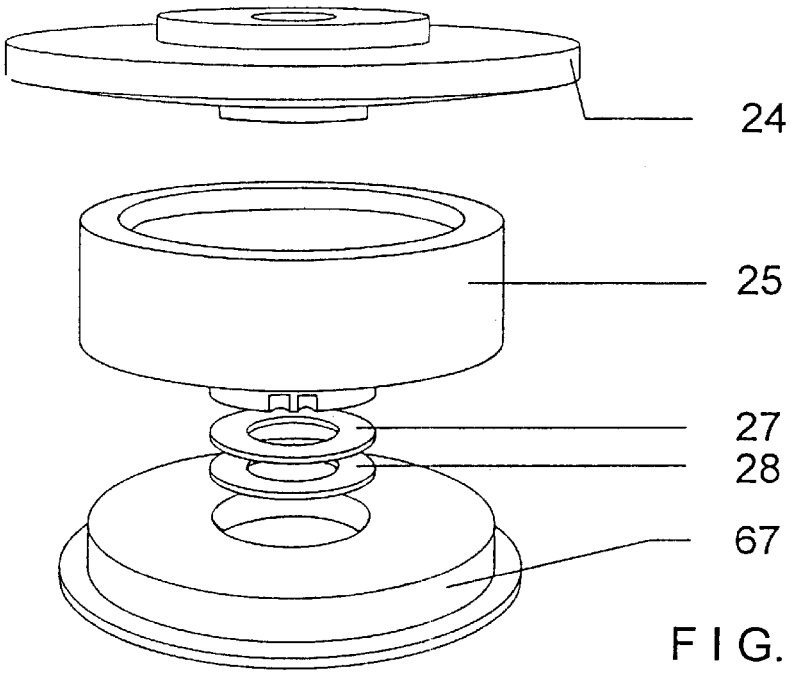
FIGS. 4A, 4B and 4C are respective plan, section and exploded views of the front and end plate, the casing and screw gear chamber.
Figure 4B:
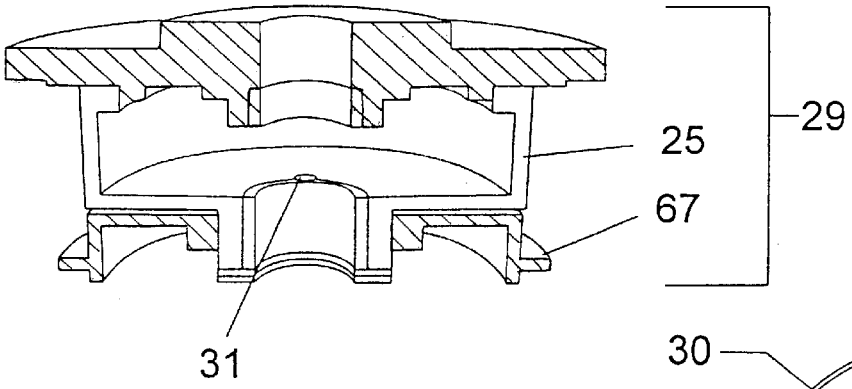
Figure 4A:
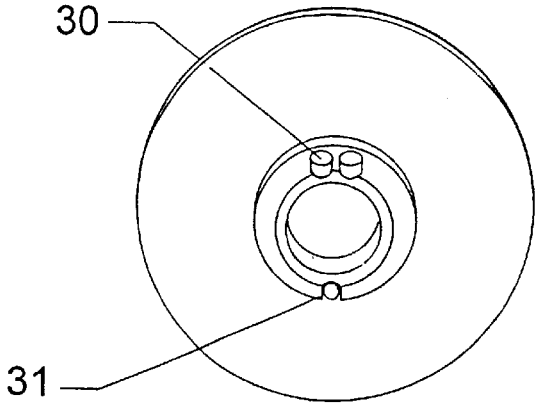
Figure 5A:
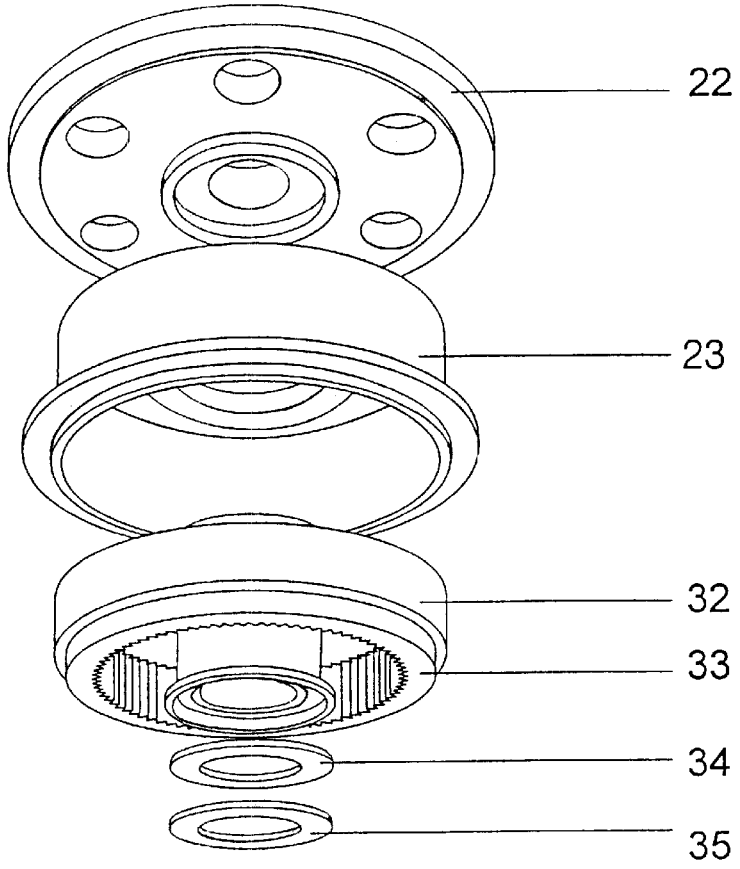
FIGS. 5A and 5B are exploded and section views of a rear end plate of the casing and drive train chamber respectively.
Figure 5B:
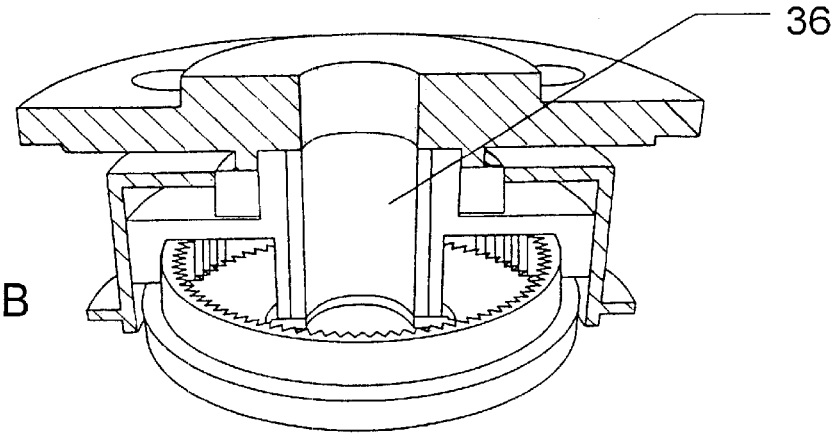
Figure 6B:
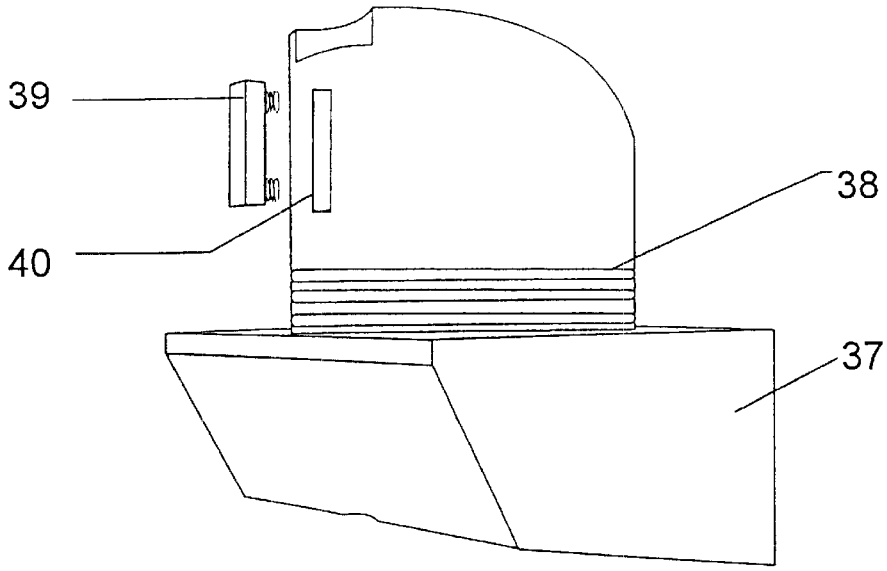
FIGS. 6A and 6B respectively are perspective and side views of the cylindrical shape valve.
Figure 6A:
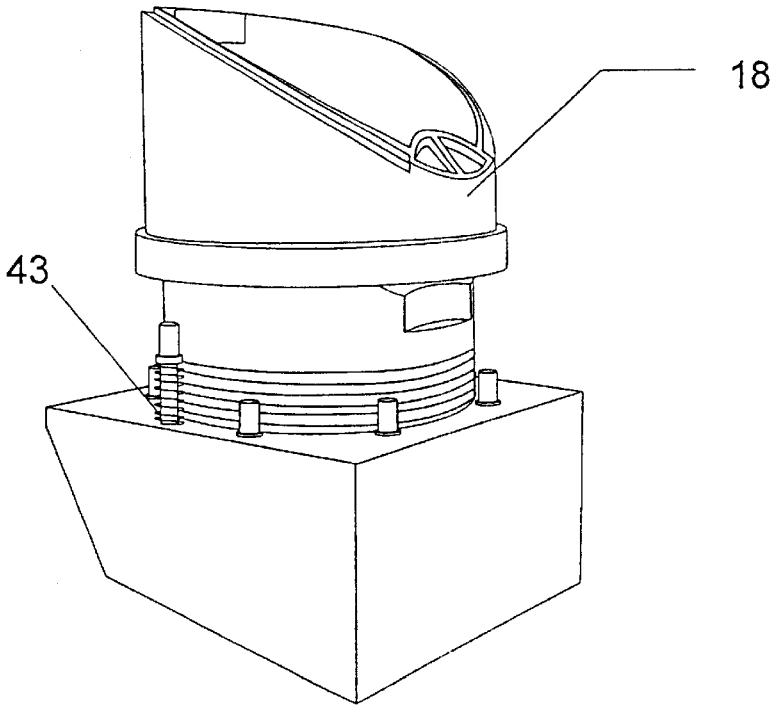
Figure 6C:
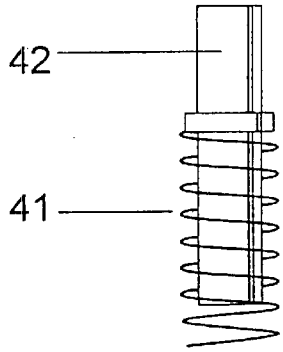
FIG. 6C is a side view of a valve stem.
Figure 7B:
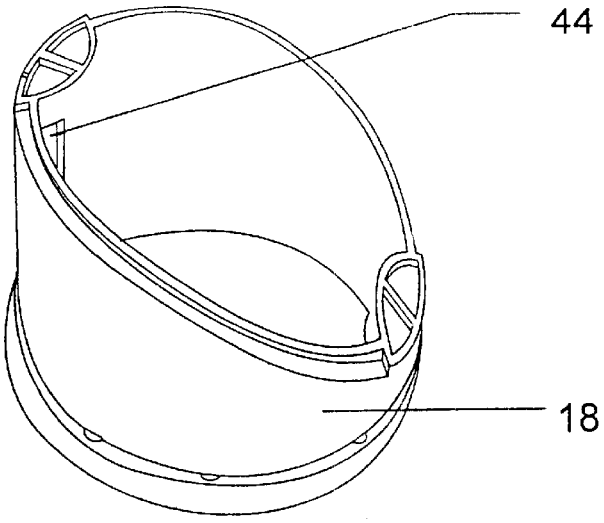
FIGS. 7A, 7B and 7C are respectively side, top and perspective views of the cylindrical shaped valve.
Figure 7C:
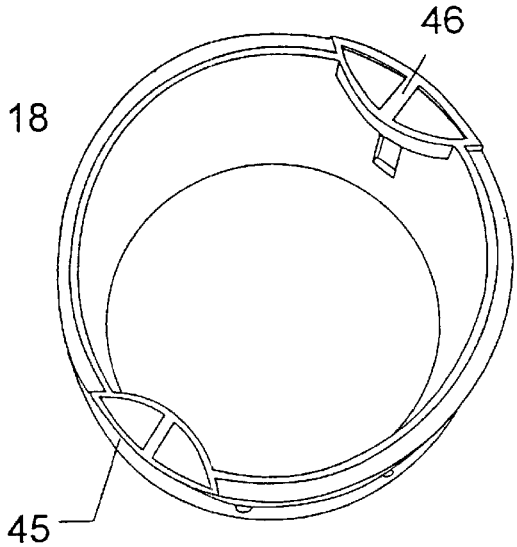
Figure 7A:
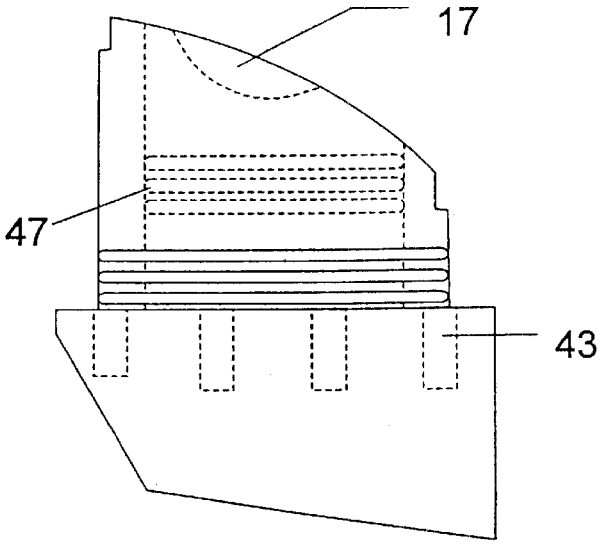
Figure 8:
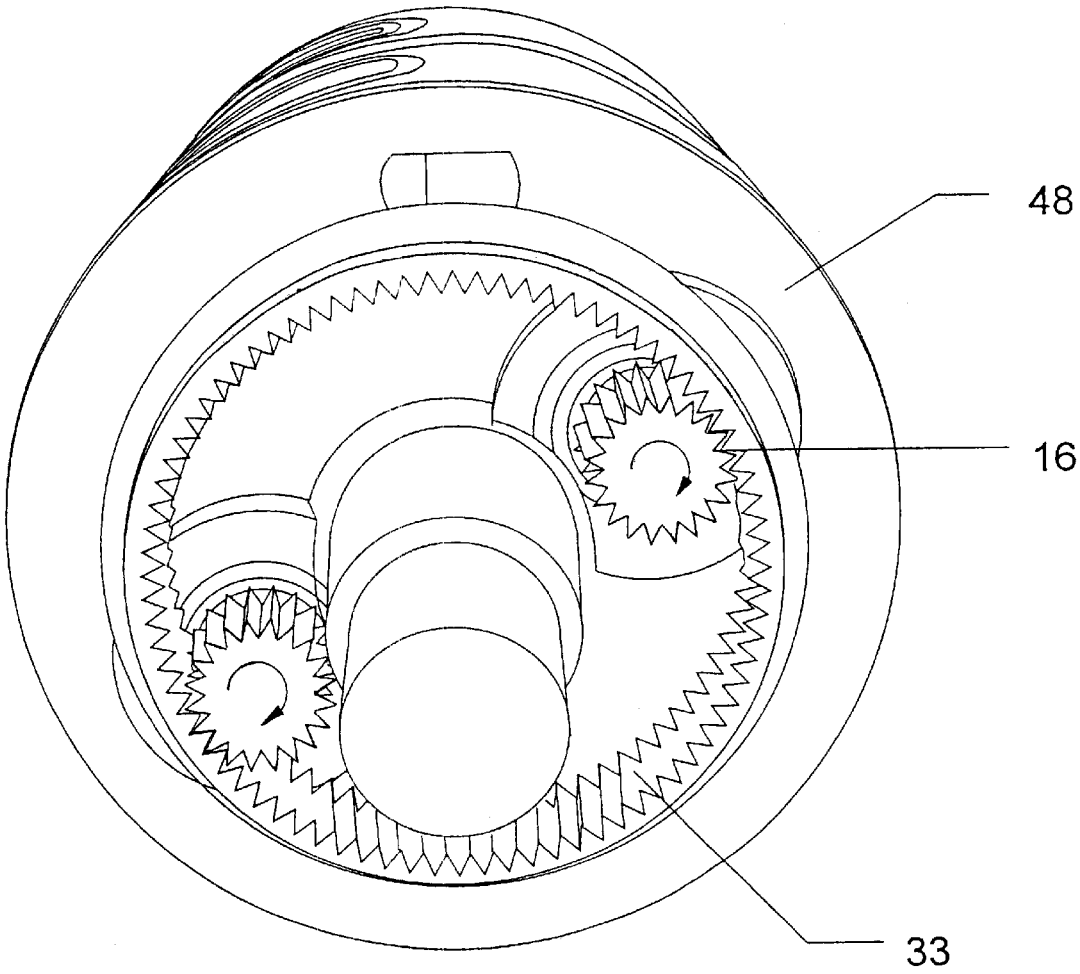
FIG. 8 is a perspective rear view of the engine.
Figure 9:
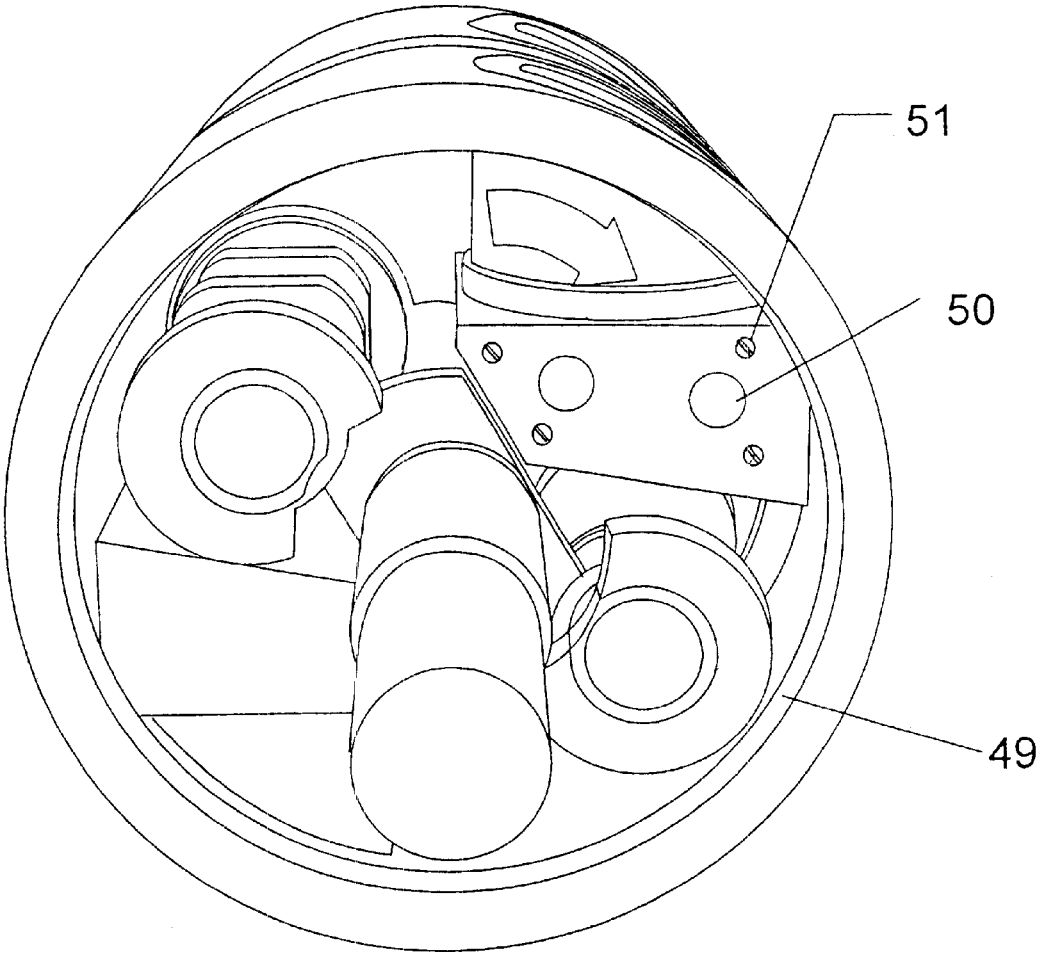
FIG. 9 is a perspective front view of the engine.
Figure 10:
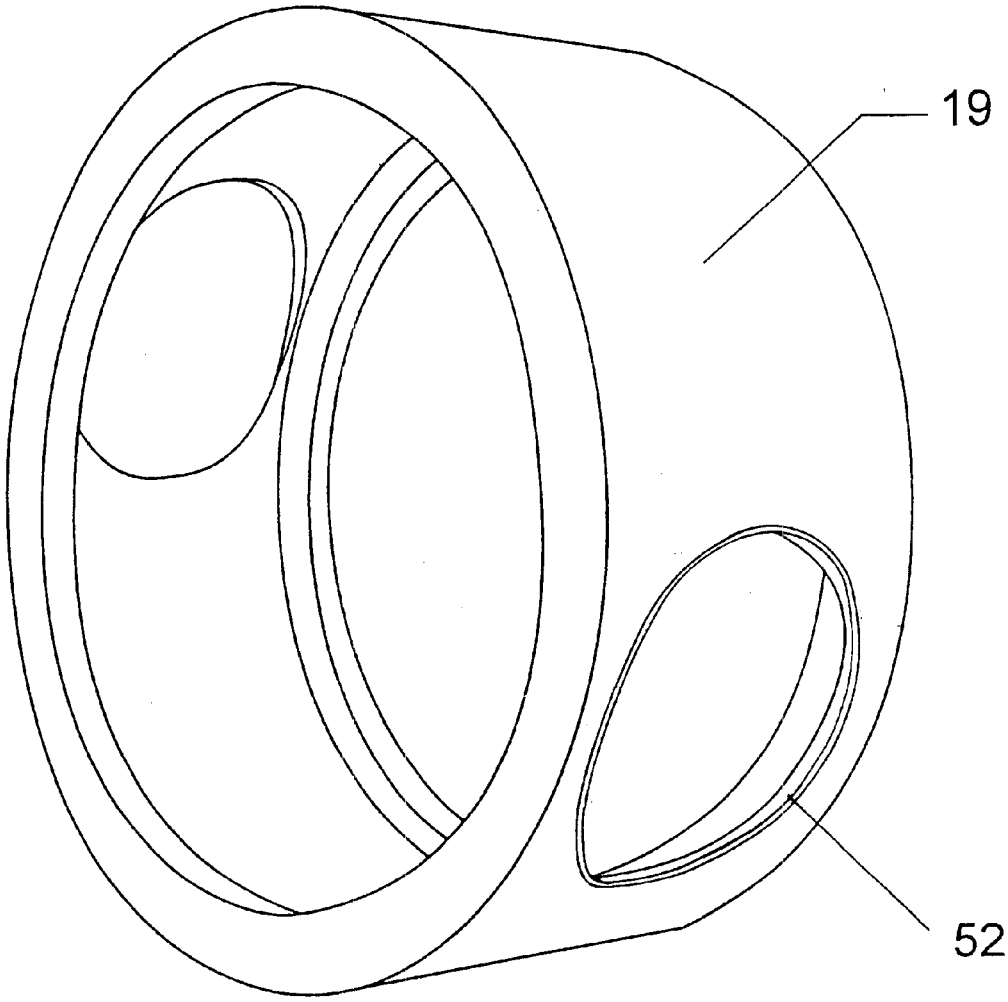
FIG. 10 is a perspective view of an annular rotor.
Figure 11A:
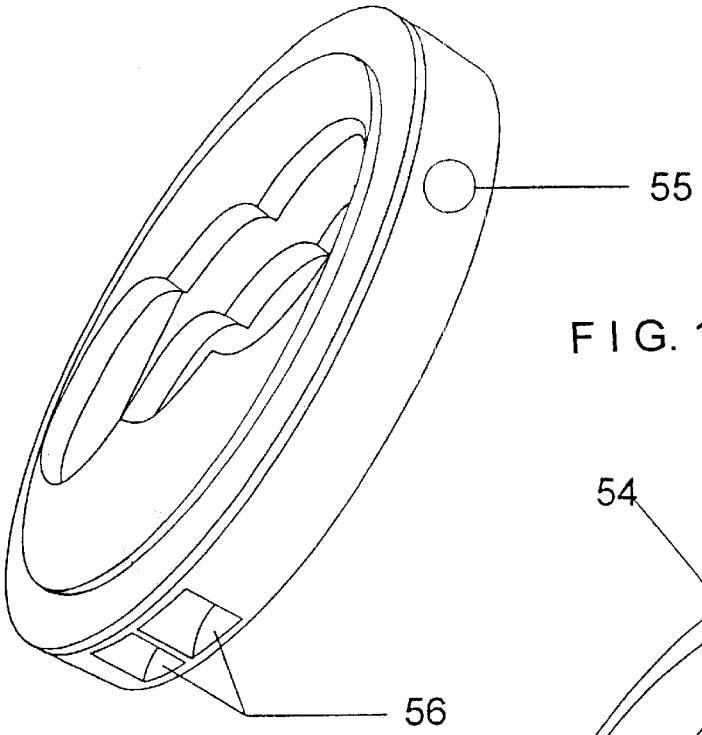
FIGS. 11A and 11B are perspective and exploded views respectively of a middle mounting plate of the crankshaft.
Figure 11B:
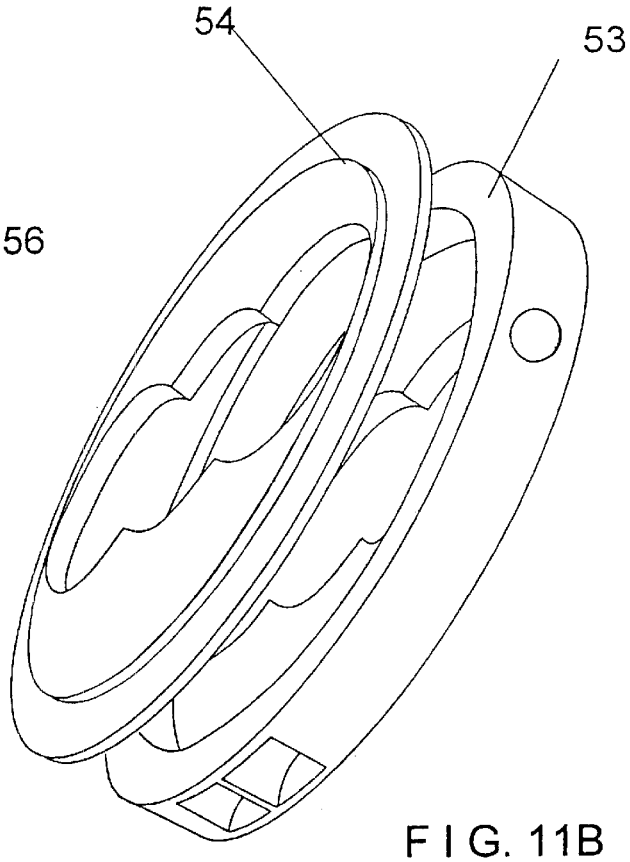
Figure 12A:
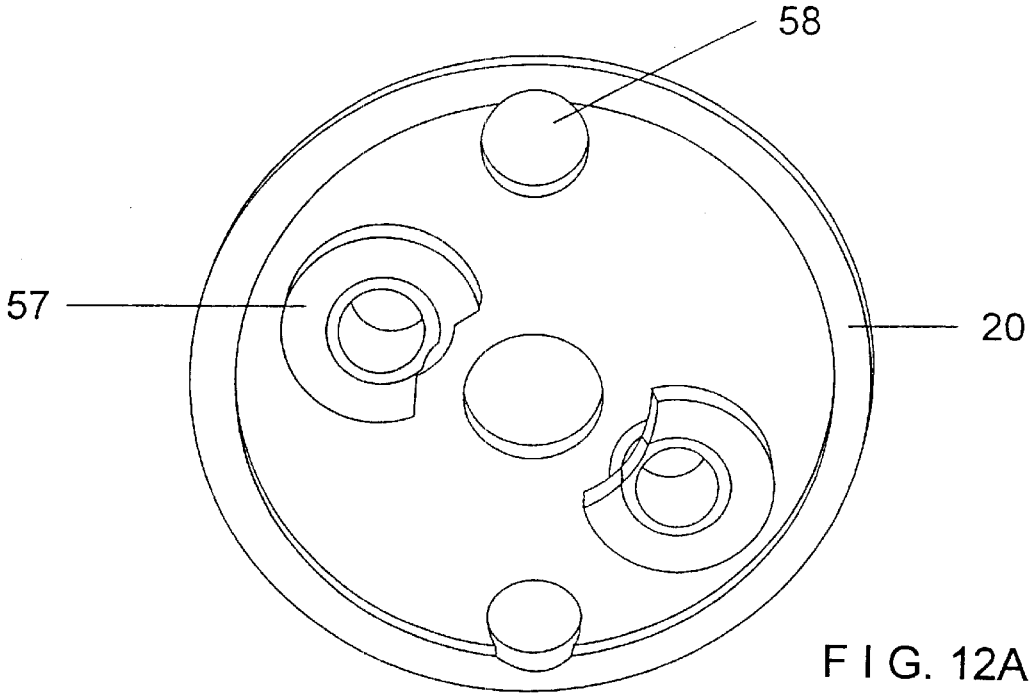
FIGS. 12A and 12B are perspective views of the front mounting plate of the crankshaft in different positions.
Figure 12B:
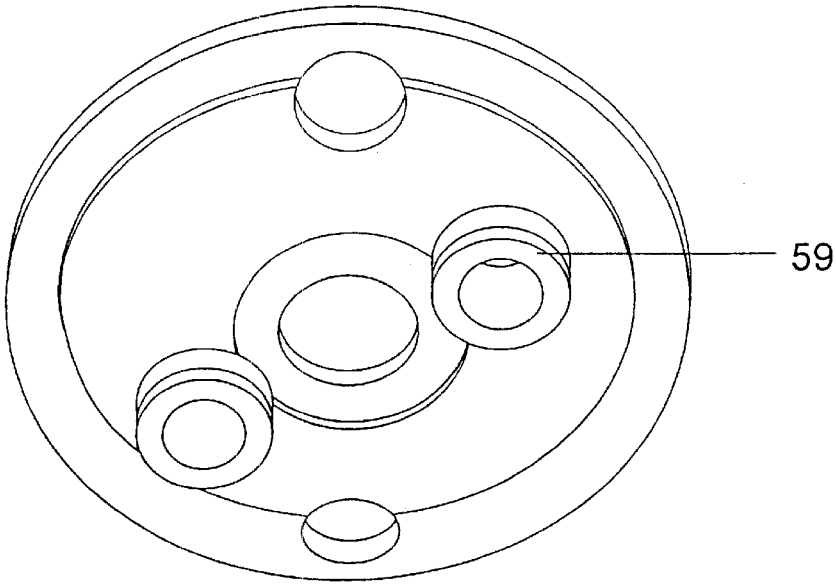
Figure 13A:
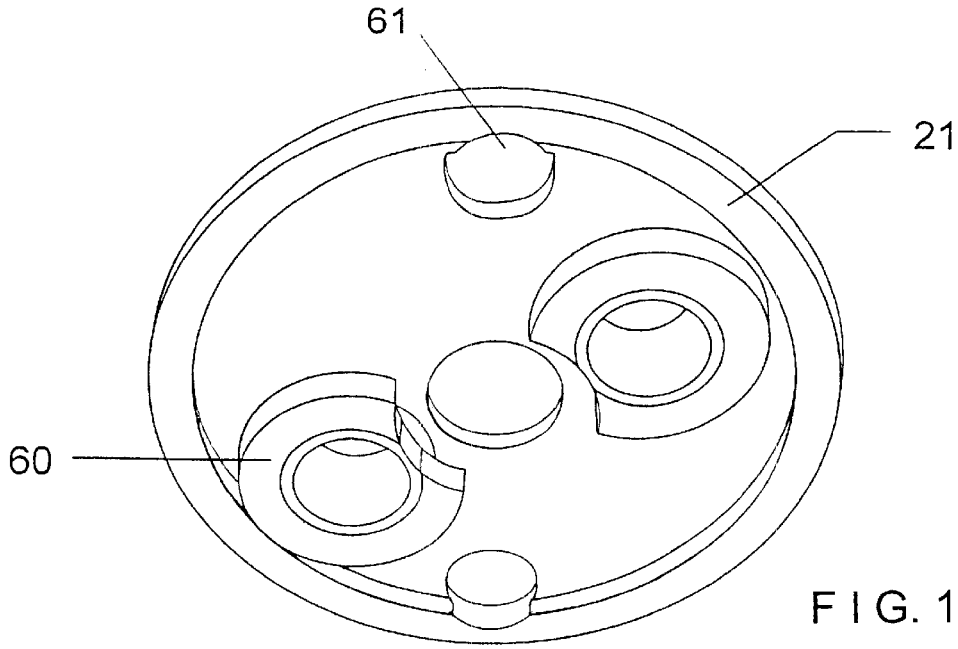
FIGS. 13A and 13B are perspective views of the rear mounting plate of the crankshaft in different positions.
Figure 13B:
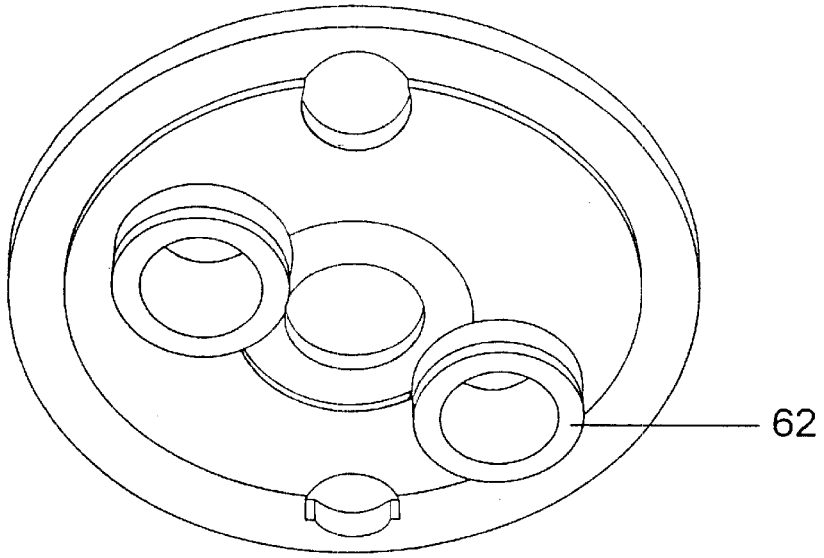
Figure 14:
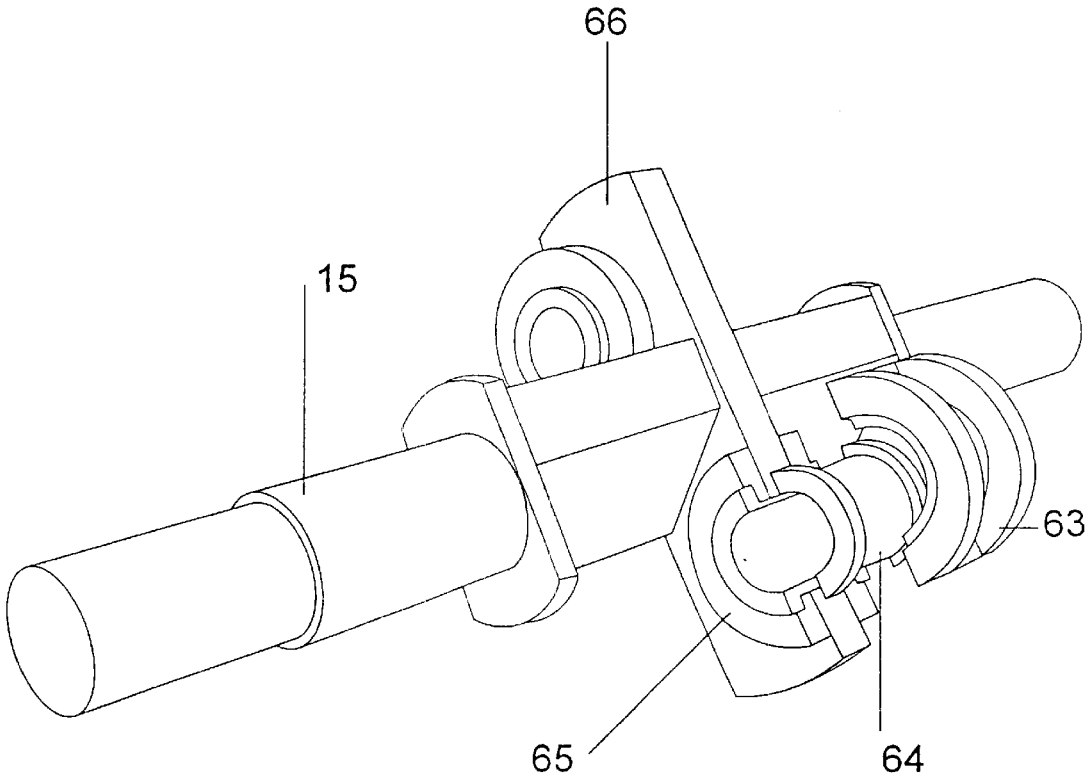
FIG. 14 is a perspective view showing the output shaft and mounting arm of the crankshaft.
Figure 15A:
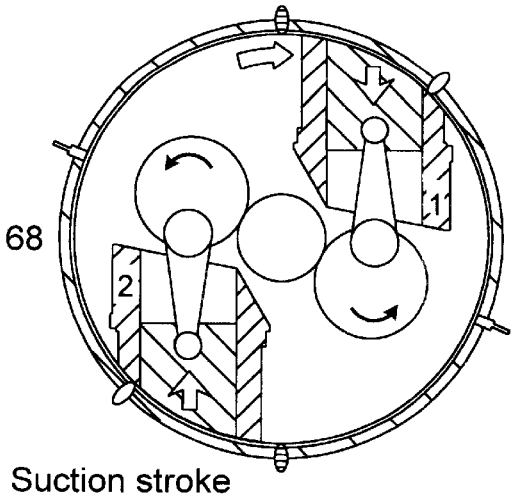
FIGS. 15A–15C show diagrams illustrating suction strokes of the first engine block; and exhaust strokes of the second engine block.
Figure 15D:
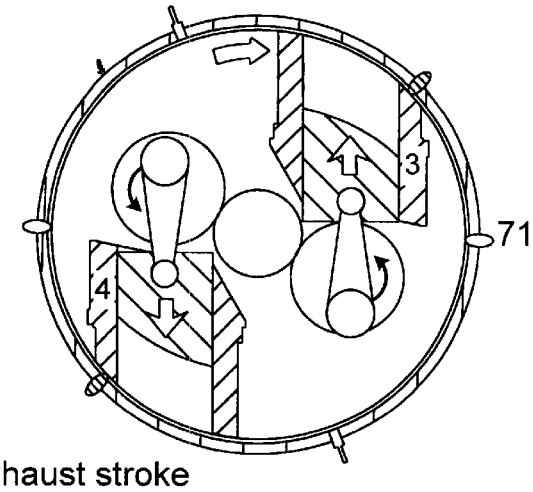
FIGS. 15D–15F show diagrams illustrating exhaust strokes of the second engine block.
Figure 15B:
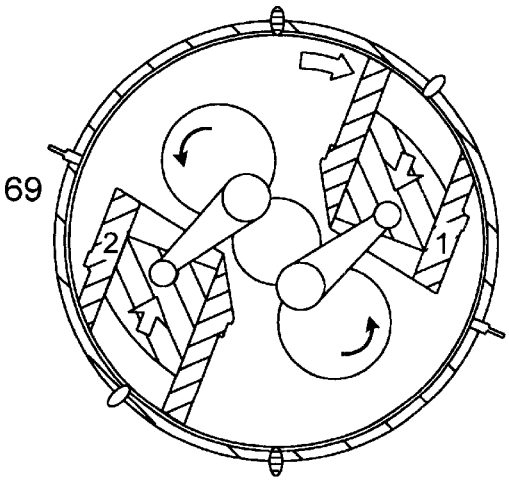
Figure 15E:
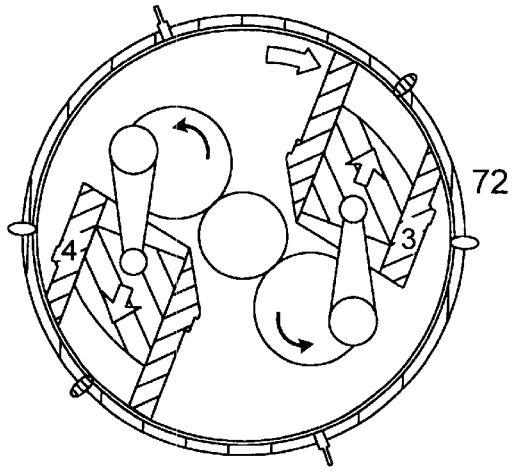
Figure 15C:
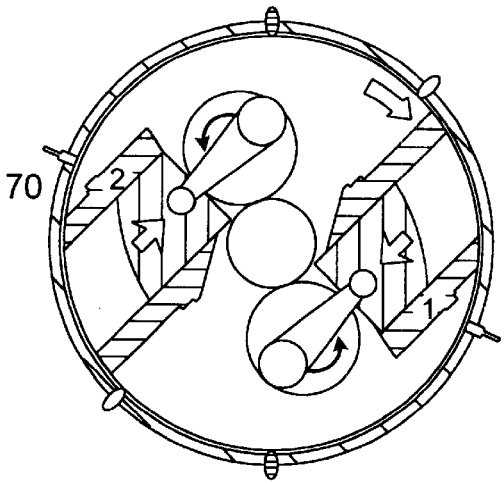
Figure 15F:
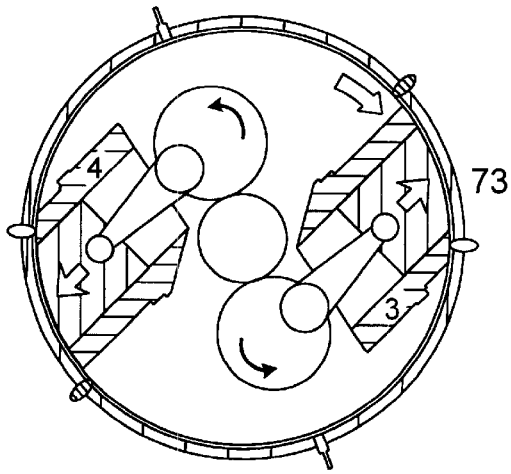
Figure 16A:
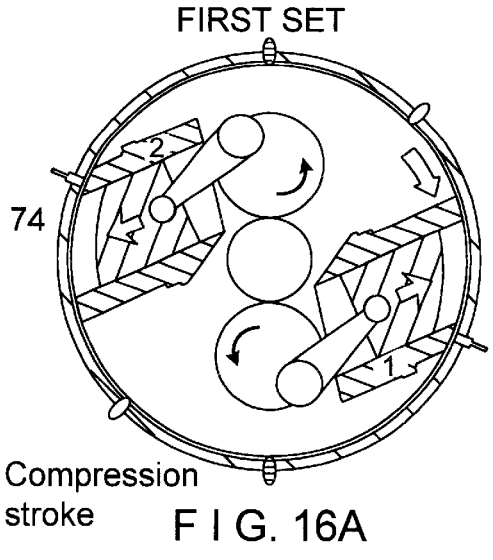
FIGS. 16A–16C show diagrams illustrating compression and power strokes of the first engine block.
Figure 16D:
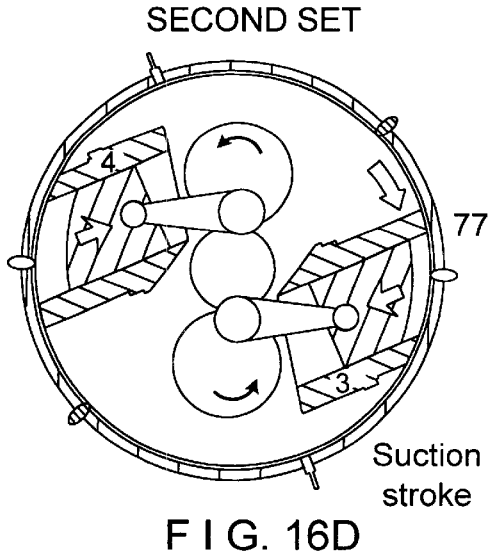
FIGS. 16D–16F show diagrams illustrating suction and compression strokes of the second engine block.
Figure 16B:
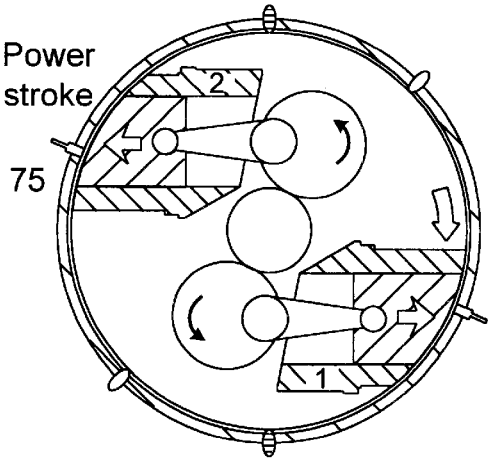
Figure 16E:
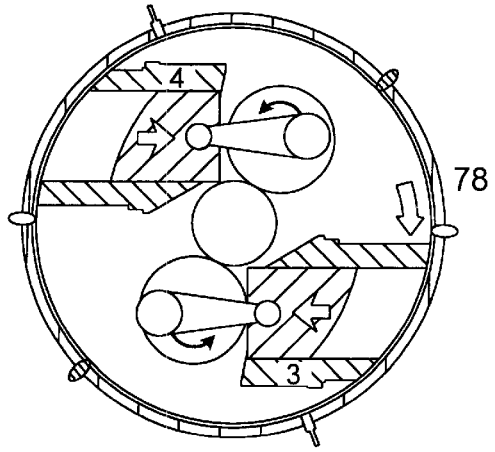
Figure 16C:
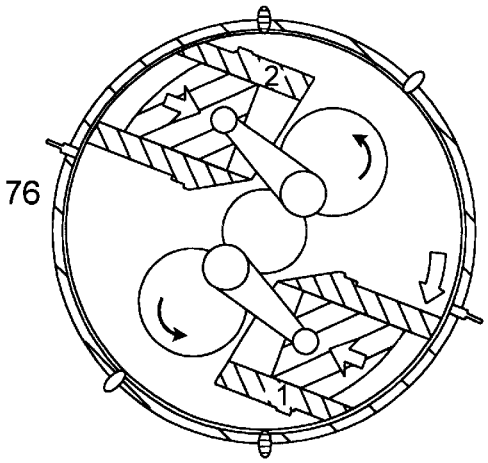
Figure 16F:
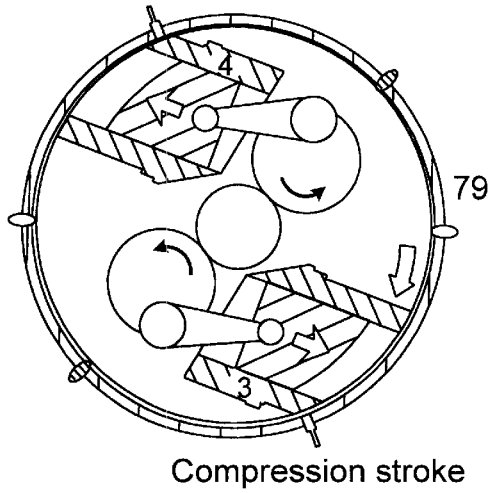
Figure 17A:
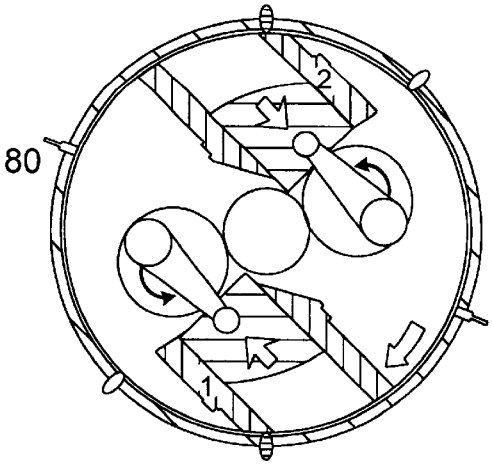
FIGS. 17A–17C show diagrams illustrating exhaust stroke of the first engine block.
Figure 17D:
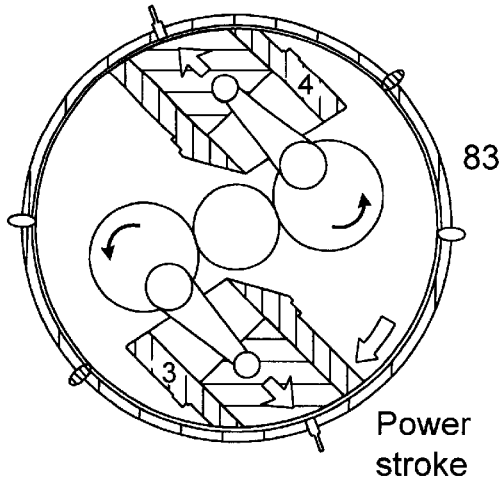
FIGS. 17D–17F show diagrams illustrating power stroke of the second engine block.
Figure 17B:
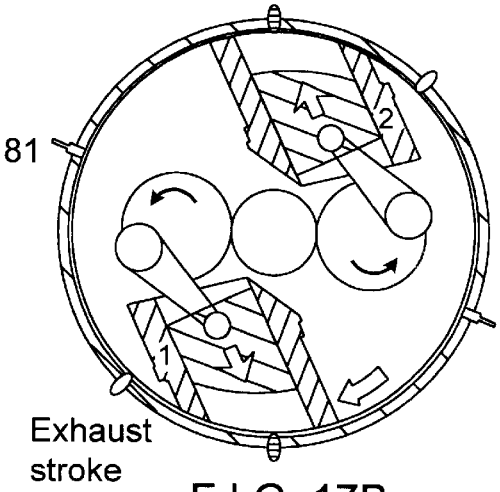
Figure 17E:
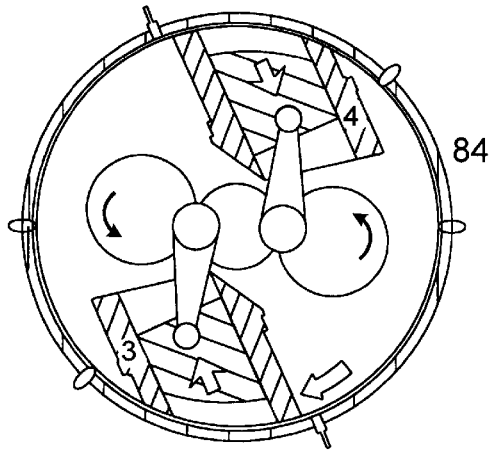
Figure 17C:
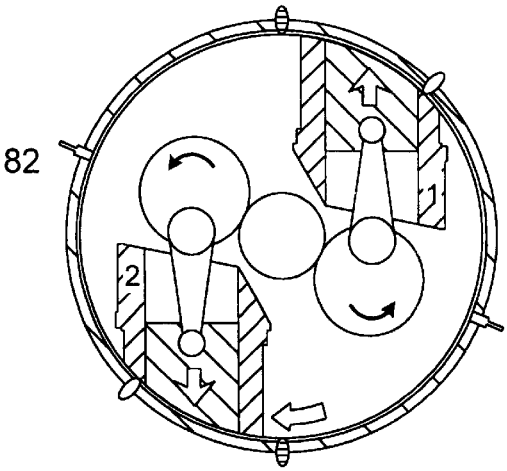
Figure 17F:
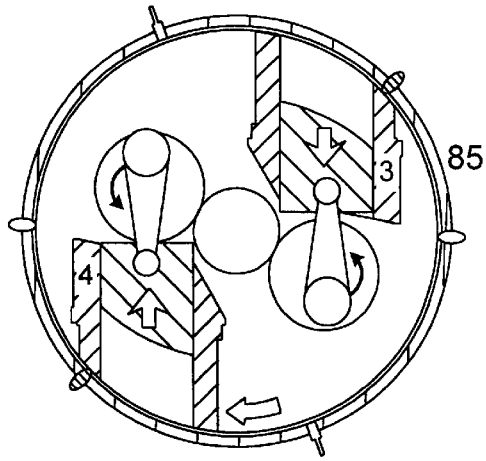

FIGS. 1 and 2, show the position of gas inlet, exhaust outlet and spark plug for the first engine block and the second engine block respectively.

Between the front end plate of casing 24 and the crankshaft front mounting plate 20 is a gear chamber 25, which encloses gear 15. The gear is formed on the front end of output shaft 13 for driving a lube oil pump and an ignition distributor.

A drive train is provided to synchronize the rotation of the output shaft 13 and both crankshaft 16. The drive train includes an annular gear-carrying cap 32 in drive train chamber 23. The drive train chamber 23 is between the rear end plate of casing 22 and the rear mounting plate 21 of the crankshaft. A sleeve to carry the output shaft is formed at the center of annular gear-carrying cap 32 with one end of this sleeve fixedly secured to the rear end plate of casing 22. An annular gear 33 is fixed to the annular gear-carrying cap 32. The annular gear 33 is in mesh with pinion gears formed on the rear ends of both crankshafts 16. The drive train establishes a gear teeth ratio of the annular gear to a pinion gear to be appropriate to engine efficiency preferably twice the number of pistons in each engine block. For example, in a typical two piston engines the gear tooth ratio of the annular gear to a pinion gear shall be 4:1 so that when the output shaft rotates once clockwise, the crankshafts will rotate four turns clockwise. Similarly, the gear tooth ratio of 3, 4, 6, 8 piston engines shall be 6:1, 8:1, 12:1 and 16:1 respectively.

As the output shaft 13 and both crankshafts 16 concurrently rotate, the pistons 17 reciprocate in their piston chambers due to the rotation of crankshaft 16. The reciprocation of the pistons is synchronized with spark plug ignition and the piston chambers then rotate clockwise to the exhaust outlet. To complete the combustion cycle, fuel mixture is drawn into the piston chamber, compressed, ignited by the spark plug, and exhausted while the piston chambers rotate clockwise.

As an example, the operation sequence of the engine as shown in the FIGS. 15, 16 and 17 illustrates two sets of engine blocks. Each block comprises two-pistons.

During suction stroke of the first engine block (FIG. 15, No. 68, 69, 70), piston chamber No. 1&2 passes through the inlet port while the piston moves down accordingly to suck the fuel air mixture into its piston chamber. When the piston complete its downward stroke, the suction stroke is also complete. At the same time the second engine block is operating in exhaust stroke (FIG. 15, No.71, 72, 73).

Compression stroke of the first engine block (FIG. 16 No.74, 75) occurs when piston chamber No.1&2 continues to move around the output shaft while the crankshaft drives piston No.1&2 move up compressing fuel air mixture. At the same time the second engine block is operating in suction stroke (FIG. 16 No.77, 78).

Ignition stroke of the first engine block (FIG. 16 No.75, 76) occurs when piston chamber No.1&2 moves further until the spark plug is positioned at the center of the piston chamber, the spark plug is then ready for ignition. Piston No.1&2 moves down after the combustion of gas in the piston chamber. At the same time the second engine block is operating in compression stroke (FIG. 16 No.79)

Exhaust stroke of the first engine block (FIG. 17 No.80, 81, 82) occurs when piston chamber No.1&2 complete its downward movement. While moving around to the exhaust port, the piston No.1&2 moves up again to expel the exhaust. When the piston No.1&2 moves up to the top position, piston chamber No.1&2 will pass through and promptly close the exhaust port. At the same time the second engine block is operating in ignition stroke (FIG. 17 No.83, 84, 85).

Piston chamber No.1 and No.2 comprise first engine block while piston chamber No.3 and No.4 form second engine block. The movement of each pair of piston as well as each pair of engine block must be balanced in order to maximize the generation of power. However, this does not limit variation of the invention. Depending on the size and power required, the engine might comprise a plurality of engine block preferably with at least two engine blocks for balancing. Again, one engine block may comprise a plurality of pistons and piston chambers preferably at least two for the same requirement for balancing. Moreover, the ignition stage of each piston will substantially equal to no of piston in each engine block that are three, four, six and eight for 3,4,6,8 piston engines respectively.

FIGS. 1 and 2 illustrate the angular spacing of the exhaust ports, inlet ports and spark plug ports. Referring to FIG. 1 it is seen that each spark plug port is spaced from an adjacent exhaust port (in the direction of rotation of the rotor) by 1.5 times the angular distance between the exhaust port and the next successive, adjacent inlet port, and is equal to the angular distance between said inlet port and the next successive adjacent spark plug port. oil pump and an ignition distributor.

Alternative embodiments envision the use of the invention as a compressor or as a pump. A compressor is basically constructed with the same structure as that of internal combustion rotary engine, having cylindrical chamber; rotor with output shaft as its axis in cylindrical chamber; crankshaft, piston, piston chamber within rotor. Expanding piston chamber created by downward movement of piston draws fluid such as air through filter connected with suction port on outer cylinder. After compression, the fluid is driven out of the exhaust port through pipe to a storage tank for future use.

Driven through coupling by electric motor or engine as prime mover, the compressor may be used to compress liquid or gas. While working as a compressor, the reciprocating piston will operate on two-stroke cycle, completing a cycle at each self-revolution of the piston chamber.

What I claim is:

1. An internal combustion rotary engine comprising:

an engine block including a fixed cylindrical casing and a rotor in said casing, said rotor having an output shaft extending rotatably and axially through said casing, said rotor including a plurality of piston chambers and pistons in said piston chambers, said pistons being reciprocable in said chambers and being uniformly and radially spaced from said output shaft in a direction of rotor rotation, said pistons having piston rods connected to crankshafts drivingly connected to said output shaft, a drive train to synchronize rotation of said crankshafts and said output shaft, said drive train including a fixed annular gear secured to said casing and pinion gears on said crankshafts in mesh with said fixed annular gear, said annular gear and said pinion gears having a tooth ratio equal to twice the number of pistons in said block, said casing having a plurality of angularly spaced ports successively communicating with said piston chambers as said rotor rotates, said ports including a plurality of inlet ports, exhaust ports, and spark plug ports each equal in number to the number of piston chambers, each spark plug port being spaced from an adjacent exhaust port by 1.5 times an angular distance between said adjacent exhaust port and the next successive adjacent inlet port and being equal to an angular distance between said next adjacent inlet port and the next successive adjacent spark plug port, a valve on each said piston chamber, each said valve having an outer cylindrically shaped surface corresponding to an inner surface of said casing and being urged by a spring to a closed position, against said inner surface of said casing, said valve providing communication between said piston chamber and said inlet and exhaust ports respectively as said rotor undergoes rotation, each piston undergoing a number of strokes during each revolution of the rotor equal to the number of pistons in said engine block, and said pistons undergoing reciprocal movement in said piston chambers in synchronism in which the pistons all have the same stroke position in said chambers.

2. The rotary engine of claim 1, wherein said drive train further includes an annular gear-carrying cap in a drive train chamber, a sleeve at a center of the annular gear-carrying cap to rotatably support the output shaft, the sleeve having a rear end fixed to a rear end plate of the casing, said annular gear being fixedly mounted on the annular gear-carrying cap.

3. The rotary engine of claim 1, wherein said pistons have cylindrically shaped ends to match the cylindrical casing.

4. The rotary engine of claim 1, wherein the output shafts of a plurality of engine blocks are drivingly connected by a synchronized connection.

5. The rotary engine of claim 1, wherein said pistons in said piston chambers are arranged in pairs, said pistons in said pairs being driven in reciprocation during a combustion cycle and having the same stroke positions in said piston chambers in the combustion cycle.

6. The rotary engine of claim 5, wherein said rotor includes two annular bodies coaxially secured together and each including respective said pistons and piston chambers.

7. The rotary engine of claim 6, wherein the pistons in each of the two annular bodies of the rotor are arranged in pairs in the respective said piston chambers and have the same stroke positions in said piston chambers in the combustion cycle.

8. The rotary engine of claim 1, wherein the piston rods are connected to the crankshafts by crank arms.

9. The rotary engine of claim 1, wherein the pistons rods at commencement of the power stroke in the combustion cycle extend axially in the piston chambers and perpendicularly to a radius of the output shaft.

* * * * *